United States Patent [19]

Madden et al.

[11] Patent Number: 4,977,740

[45] Date of Patent: Dec. 18, 1990

[54] DUAL FUEL INJECTOR

[75] Inventors: Thomas J. Madden, Vernon; Barry C. Schlein, Wethersfield; W. Barry Wagner, Bolton, all of Conn.

[73] Assignee: United Technologies Corporation, Hartford, Conn.

[21] Appl. No.: 362,534

[22] Filed: Jun. 7, 1989

[51] Int. Cl.[5] ..... F02C 3/22; F02C 3/30; F02C 7/22

[52] U.S. Cl. ..... 60/39.463; 60/39.55; 60/742; 239/424.5

[58] Field of Search ..... 60/39.463, 39.465, 39.55, 60/742, 750; 239/424, 424.5, 425

[56] References Cited

U.S. PATENT DOCUMENTS

| | | | |
|---|---|---|---|
| 3,763,650 | 10/1973 | Hussey et al. | 60/39.74 |
| 3,937,011 | 2/1976 | Carvel et al. | 60/39.71 |
| 4,327,547 | 5/1982 | Hughes et al. | 60/39.46 |
| 4,337,618 | 7/1982 | Hughes et al. | 60/39.55 |
| 4,342,198 | 8/1982 | Willis | 60/742 |
| 4,425,755 | 1/1984 | Hughes | 60/39.55 |
| 4,600,151 | 7/1986 | Bradley | 239/424 |
| 4,857,075 | 8/1989 | Lipp | 239/424.5 |

*Primary Examiner*—Louis J. Casaregola
*Attorney, Agent, or Firm*—Gene D. Fleischhauer

[57] ABSTRACT

A fuel injector 28 for gaseous and liquid fuel is disclosed. Various construction details are developed to enhance mixing and reduce nitrogen oxide emissions in a compact design. In one embodiment of the invention, the fuel nozzle 28 includes two radially spaced passages 68, 104 for air having swirlers 86, 112 and a liquid fuel passage 57 disposed between the air passages and a gaseous fuel passage 116 outwardly of the outermost air passage. In one detailed embodiment, a center body 76 is disposed in the inner air chamber to promote re-ciruclation of the hot gases.

4 Claims, 2 Drawing Sheets

DUAL FUEL INJECTOR

TECHNICAL FIELD

This invention relates to an apparatus for injecting gaseous or liquid fuel into a combustion chamber with water in the form of steam or liquid. Although this invention was developed in the field of gas turbine engines, it is applicable to any machine having a flowpath for pressurized air which extends through a combustion chamber.

BACKGROUND OF THE INVENTION

A typical axial flow, industrial gas turbine engine has a compression section, a combustion section, and a turbine section. An annular flowpath for working medium gases extends axially through the sections of the engine.

At the inlet to the compression section, the gases are primarily air. As the working medium gases are flowed along the flowpath, the gases are compressed in the compression section causing the temperature and the pressure of the gases to rise. The temperature of the gases exiting the compression section may exceed eight hundred (800) degrees Fahrenheit.

The hot, pressurized gases are flowed from the compression section to the combustion section. In the combustion section, the gases are mixed with fuel and are burned to add energy to the gases. These heated, high energy gases are expanded through the turbine section to produce useful work, such as by driving a turbine rotor that powers the compressor and by driving a second (or free) turbine which may be drivingly connected to a pump or electrical generator.

The combustion section includes one or more combustion chambers and a plurality of fuel injectors for supplying air and fuel to the combustion chambers. Examples of such fuel injectors are shown in U.S. Pat. No. 4,327,547 issued to Hughes et. al. entitled "Fuel Injectors" and U.S. Pat. No. 4,337,618 issued to Hughes et. al. entitled "Gas Turbine Engine Fuel Burners". The fuel injectors shown in these patents are capable of burning liquid fuel and gaseous fuel. Each fuel injector incorporates a water injection system for supplying water to the burning fuel to reduce the formation of nitrogen oxides ($NO_x$).

The fuel injector shown in U.S. Pat. No. 4,337,618 has an inner wall extending circumferentially about an axis to bound an inner chamber for receiving air from an upstream location, such as the discharge of the compressor. A pintle disposed in the inner chamber extends axially through the chamber and downstream of the chamber to define an annular passage 62 for the air.

As the air is flowed along the passage in the inner air chamber, fuel is discharged into the air so that mixing of the fuel and air takes place within the inner chamber, thus premixing the fuel and air within the fuel injector. An annular second passage 68 outwardly of the first passage 62 provides a flowpath for air and water. A gaseous fuel is flowed through a third passage 44,46 which is disposed radially outwardly of the first two passages.

The fuel, air and water are discharged into the combustion region of the combustion chamber where the gases are ignited and burned. As the gases are burned downstream of the injector nozzle, the hot gases may recirculate through a location adjacent to the pintle and may, in some constructions, cause overheating of the pintle with an adverse effect on the durability of the pintle. In addition, the recirculating gases may ignite the liquid fuel and air mixture within the inner chamber causing further heating of the end of the pintle. If the pintle is hollow as shown in U.S. Pat. No. 4,327,547, the recirculating gases may extend axially upstream into the pintle, causing further heating of the pintle on the interior of the pintle.

Scientists and engineers under the direction of Applicants' Assignee are working to improve fuel injector assemblies and particularly: (1) to improve the mixing of liquid fuel and air and the mixing of gaseous fuel and air at a location downstream of the fuel injector; (2) to provide for the injection of water to reduce the formation of nitrogen oxides; and, (3) to employ a construction which avoids local overheating of the components of the injector while providing recirculation of the combustion gases to improve flame stability at low fuel/air ratios.

DISCLOSURE OF INVENTION

This invention is predicated in part on the recognition that providing an axially extending center body to an inner air passage of a coaxial dual fuel injector will increase flame stability under operative conditions having a lean fuel/air mixture.

This invention is also predicated in part on the recognition that air discharged from the compressor of the engine, and flowing over a center body which is entirely disposed in the inner air passage, will provide a region of cooling air between the recirculating gases in the combustion chamber and bathe the entire length of the center body in cooling air.

According to the present invention, a fuel injector for gaseous and liquid fuel includes two radially spaced passages for air, each having swirlers to impart a tangential velocity to the air, a liquid fuel passage disposed between the air passages for discharging fuel mixed with water into a downstream region and a gaseous fuel passage outwardly of the outermost air passage for discharging gaseous fuel and steam into the downstream discharge region, the fuel passages being in flow communication with water in the same state as the fuel for efficiently injecting water into the nozzle to suppress the formation of nitrogen oxides.

In accordance with one embodiment of the present invention, a center body is disposed in an inner air chamber to form the inner air passage and extends into proximity with the downstream end of the chamber to promote recirculation of the hot gases but is axially spaced from the downstream end of the passage to promote cooling of the center body with the relatively cool air flowing through the inner air chamber.

In one detailed embodiment, the center body has a downstream surface which blocks recirculation of gases into the interior of the center body.

A primary feature of the present invention is a fuel injector which includes an inner air passage, an outer air passage, a liquid fuel passage disposed between the air passages and a gaseous fuel passage disposed radially outward of the outer air passage. Swirlers are disposed in each of the air passages to impart tangential velocity to air flowing through the passages. The fuel passages adapt the injector to receive water via the liquid fuel passage and steam via the gaseous fuel passage to provide for the efficient injection of water into the discharge region of the injector. In one detailed embodiment, a primary feature is an axially extending center body which is disposed entirely within the inner air chamber. The center body is spaced axially from the downstream end of the inner air chamber to provide a sudden expansion region in the inner air chamber. In one embodiment, a conduit for supplying liquid fuel to the liquid fuel passage extends across the outer air chamber adjacent to the upstream end of the air chamber; and, the swirler is located at the downstream end of the outer air chamber to minimize the disruption of the swirling air resulting from the conduit extending across the outer air passage. The gaseous fuel conduit is in flow communication with the outermost passage to avoid any disruption of the air passages by the gaseous fuel conduit.

A primary advantage of the present invention is reduced nitrogen oxide emissions which results from using a fuel injector to efficiently mix water with fuel. Still another advantage is the compact design which results from minimizing the local blockage by gaseous fuel conduits of air flow within the air passages by placing the liquid passage with its smaller conduit inwardly of the outer air passage and placing gaseous fuel passage with its larger conduit outwardly of the outer air passage. Another advantage is the stability of combustion at low (lean) fuel/air ratios which results from the center body providing a sudden expansion to the inner air stream and the swirlers providing swirling air flow which promotes the formation of recirculation zones for hot gases. Still another advantage is the durability of the center body which results from bathing the center body in a film of relatively cool air under all operative conditions of the engine and the configuration of the center body which blocks recirculating gases from entering the interior of the center body by bounding the sudden expansion region with an axially facing surface at the downstream end of the center body.

The foregoing features and advantages of the present invention will become more apparent in light of the following detailed description of the best mode for carrying out the invention and in the accompanying drawings.

BRIEF DESCRIPTIONS OF DRAWINGS

BEST MODE FOR CARRYING OUT THE INVENTION

Figure 1:
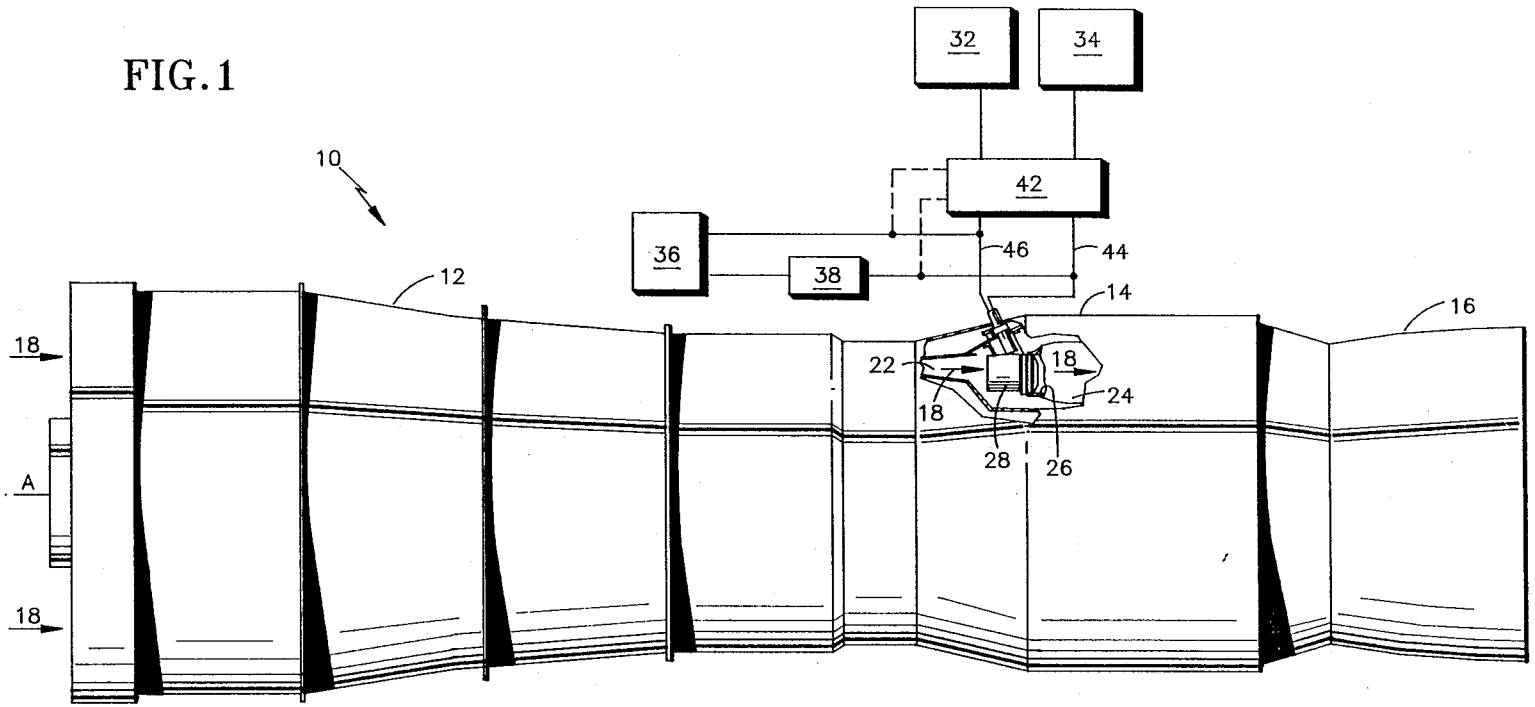
FIG. 1 is a side elevation view of an axial flow rotary machine showing a flowpath for working medium gases with part of the engine broken away to show a portion of a combustion section of the engine.

FIG. 1 is a side elevation view of an axial flow rotary machine 10 of the industrial gas turbine engine type. The engine has an axis A. A compression section 12, a combustion section 14, and a turbine section 16 are disposed circumferentially about the axis A. An annular flowpath 18 for working medium gases extends circumferentially about the axis A and rearwardly through the sections of the engine.

The compression section 12 includes a diffuser region 22 which is immediately upstream of the combustion section 14. One or more combustion chambers, as represented by the combustion chamber 24 in the combustion section 14, extend axially downstream of the diffuser region. Each combustion chamber is adapted by one or more openings 26 to received pressurized gases in the form of air from the diffuser region of the compression section. These gases are relatively hot in comparison to ambient temperature but are relatively cool with respect to the products of combustion which are formed in the combustion chamber.

A fuel injector, as represented by the fuel injector 28, is disposed in an associated opening 26 in the combustion chamber 24 to pass the pressurized gases (air) from the compression section to the combustion chamber and to inject fuel into the air after the air is discharged into the discharge region of the injector. An igniter (not shown) extends into the combustion chamber to ignite the mixture of fuel and air as the air passes from the discharge region of the fuel injector.

As shown in schematic fashion, the gas turbine engine is provided with a source of liquid fuel 32, a source of gaseous fuel 34 and a source of water 36. A heat exchanger 38 is provided to provide a source of steam from the source of water. The heat exchanger may be regeneratively heated by the hot gases discharged from the gas turbine engine.

An electronic fuel control 42, such as the fuel control Model Series DCS501 manufactured by the Woodward Governor Company, Fort Collins, Colo., controls the flow of liquid fuel and water to the fuel injector and the flow of gaseous fuel and steam to the fuel injector. A first conduit means 44 is in flow communication with the fuel injector and is adapted to be in flow communication with the source of gaseous fuel and the source of steam for supplying a mixture of gaseous fuel and steam to the fuel injector. A second conduit means 46 is in flow communication with the fuel injector and is in flow communication with the source of liquid fuel and the source of water for supplying a mixture of liquid fuel and water to the fuel injector.

Figure 2:
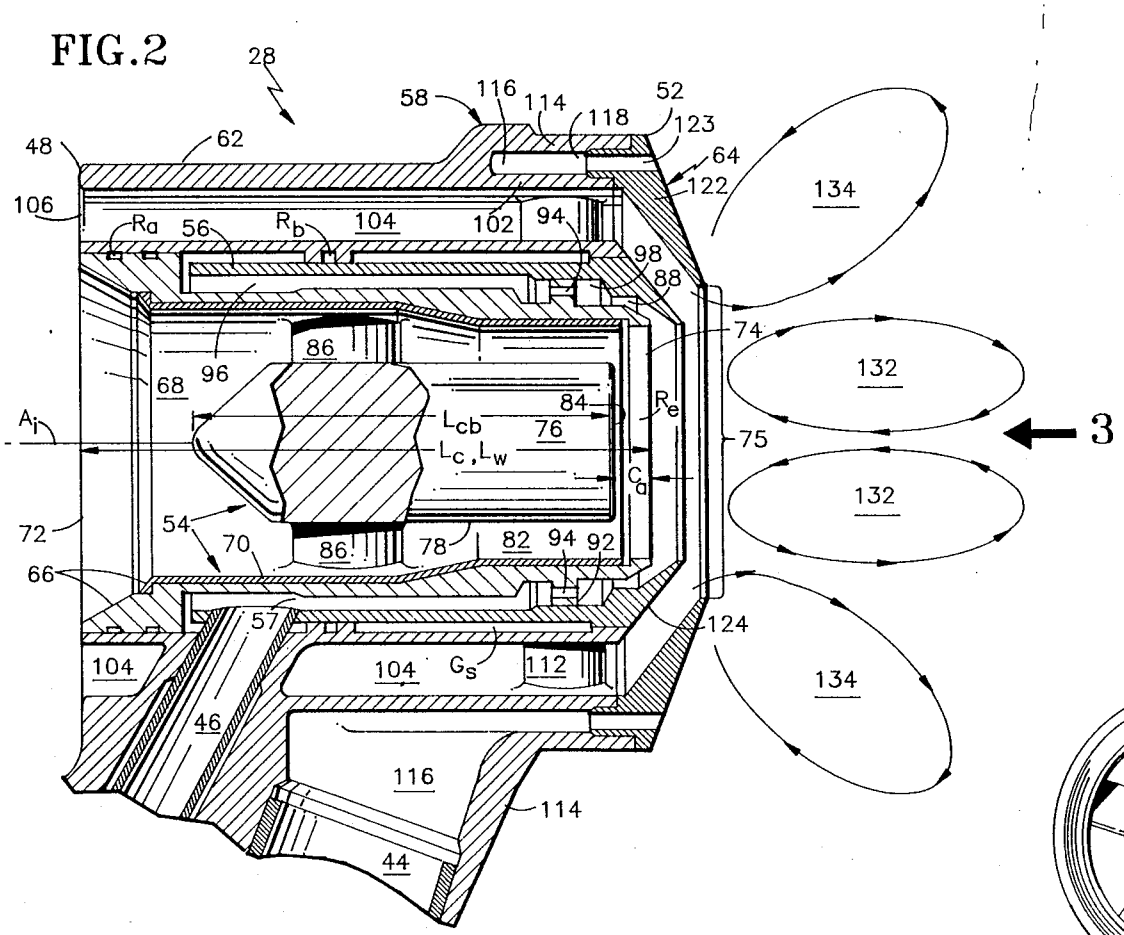
FIG. 2 is a cross sectional view of the fuel injector assembly shown in FIG. 1 with a portion of the center body broken away to show the center body is of a solid construction.

FIG. 2 is an enlarged cross sectional view of the fuel injector 28 shown in FIG. 1. The fuel injector has an upstream end 48 and a downstream end 52. The fuel injector includes an inner air supply means 54 having a smaller diameter at the downstream end and a larger diameter at the upstream end. A first outer wall 56 extends axially over the downstream end of the inner air supply means and is spaced radially from the inner air supply means 54 leaving a passage 57 for liquid fuel therebetween.

A casing 58 extends axially over the downstream end of the first outer wall and axially over the larger diameter portion of the upstream end of the inner air supply means. The casing has a manifold section 62 and a conical deflector section 64 which are integrally joined together to form a one-piece construction. Alternatively, these two sections might be formed as one piece.

The inner air supply means includes an inner wall 66 extending circumferentially about the axis $A_i$ of the fuel injector leaving an inner air chamber 68 inwardly of the wall. The inner air chamber has a length $L_c$.

The inner wall includes a heat shield 70 which extends circumferentially about the inner wall to bound the inner air chamber and to shield the inner wall from the pressurized gases discharged from the compressor which are relatively hot in comparison to the liquid fuel in the liquid fuel passage 57. The inner wall 66 has an upstream end 72 is open to receiving air from an upstream location, such as the diffuser region 22 of the compression section 12. The inner wall has a downstream end 74 for discharging air into the discharge region 75 of the fuel injector.

The inner air supply means includes a center body 76 which is solid and which is disposed entirely within the inner chamber 68. The center body extends axially in the inner chamber and has an axial length $L_{cb}$.

The center body has an outer surface 78 which extends axially and which is spaced radially from the inner wall leaving a first annular passage 82 for air therebetween. The center body extends axially toward and into close proximity with the downstream end 74 of the inner wall 66. The center body has a downstream end surface 84 which extends radially to join the outer surface in blocking gases from entering the center body. Accordingly, the center body does not have a concave surface at the downstream end which would permit gases to enter the center body.

The downstream end surface 84 is spaced axially from the downstream end of the wall by a distance $C_a$ leaving a gap therebetween to provide a region of sudden expansion Re within the inner chamber for the air downstream of the center body. The axial gap $C_a$ may range from approximately two per cent to four per cent of the length of the inner air chamber $L_c$, but may, in some constructions be ten percent of the length of the inner air chamber. The axial length $L_{cb}$ of the center body is greater than half the axial length of the inner wall $L_w$ or the inner chamber $L_c$. The preferred range for the length of the center body is seven tenths to nine tenths of the length $L_c$ of the inner chamber. ($0.9 \geqq L_{cb}/L_c \geqq 0.7$). The preferred range for the area of the center body at the region of sudden expansion $R_e$ is two-tenths to six-tenths of the area of the inner air chamber at that location($0.6 \geqq A_{cb}/A_c \geqq 0.2$).

A plurality of swirl vanes, as represented by the two swirl vanes 86, are disposed within the first passage at an axial location which is about midway between the upstream end 72 and the downstream end 74 of the inner wall. The swirl vanes extend between the inner wall and the center body 76 to support the center body. The swirl vanes provide means for imparting a tangential velocity to the air passing through the first passage 82.

The first outer wall 56 is spaced radially from the inner wall 66 leaving the second annular passage 57 for liquid fuel therebetween. The first outer wall is hollow having an internal gap $G_s$ along an axial portion of the first outer wall adjacent to the second annular passage. The second annular passage has a downstream end 88 for discharging liquid fuel into the discharge region of the fuel injector. An annular projection 92 from the inner wall 66 extends circumferentially between the inner wall and the first outer wall, spacing the first outer wall from the inner wall. A plurality of axially extending orifices 94 divide the liquid fuel passage into an upstream zone 96 and a downstream zone 98 and help meter the flow of fuel between the upstream zone and the downstream zone and into the discharge region 75.

The casing 58 has a second outer wall 102 spaced radially from the first outer wall 56 leaving a third annular passage for air 104 therebetween. The third annular passage has an upstream end 106 which is open to receiving air from the upstream location which is the discharge region 22 of the compression section 12. The third passage has a downstream end 108 for discharging air into the discharge region. Means for imparting tangential velocity to the air passing through the second annular passage, as represented by the two canted swirl vanes 112, are disposed in the third annular passage. The swirl vanes are adjacent to the downstream end of the nozzle.

The casing includes a third outer wall 114 which is spaced radially from the second outer wall 102 leaving a fourth annular passage for gaseous fuel 116 therebetween. The fourth annular passage has a downstream end 118 for discharging gaseous fuel into the discharge region of the fuel injector. The conical deflector section 64 of the casing includes a conical deflector 122 which is integrally joined to the manifold section 62 of the casing 122. The conical deflector has a plurality of axially extending holes 123 for metering the flow of gaseous fuel and/or steam into the discharge region 76 of the fuel injector. The conical deflector extends inwardly towards the axis $A_i$ of the injector to deflect the swirling air of the third annular passage 104 toward the liquid fuel discharged from the second annular passage 57.

The first conduit means 44 is in flow communication with the fourth annular passage 116. The first conduit means is adapted to receive gaseous fuel and steam from the source of gaseous fuel 34 and from the source of steam 38. Under some operative conditions of the engine, it might be possible to flow only steam through the gaseous fuel passage. The second conduit means 46 extends across the third annular passage 104 for air to the second annular passage 57 for fuel. The second conduit means is in flow communication with the source of liquid fuel 32 and the source of water 36. The axial location of the second conduit means is adjacent to the upstream end 48 of the fuel injector to minimize the disruption of the circumferential flow of air in the air passage 104 prior to the air flow passing through the downstream swirl vanes 112.

Figure 3:
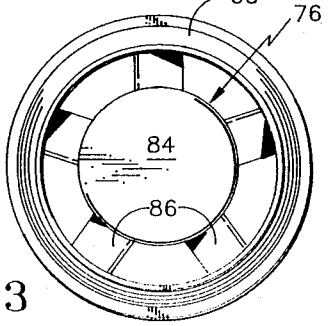
FIG. 3 is a view in the direction 3 shown in FIG. 2.

FIG. 3 is a view taken in the direction 3 of FIG. 2 showing the relationship of the radially extending, blunt downstream end surface 84 of the center body 76 to the swirl vanes 86 and to the inner wall 66.

During operation of the axial flow rotary machine 10 working medium gases are flowed along the working medium flowpath 18. The gases are in the form of air when discharged from the compressor into the diffuser region 22. The air enters the open upstream end 48 of the fuel injector passing through the first annular passage 82 and the third annular passage 104 to form two swirling columns of air which are radially spaced one from the other. Fuel and water are flowed via the second annular passage between these two columns. The shield 70 disposed between the first annular passage and the second annular passage and the gap $G_s$ in the first outer wall block the transfer of heat from the air in the first annular passage and the third annular passage to the liquid fuel and water in the second annular passage. The fuel and water are directed toward the inner air stream by a conical deflector 124 at the downstream end of the first outer wall 56. The conical deflector 122 on the third outer wall deflects the outer air stream towards the fuel and water stream and the inner air stream causing, a shearing action which atomizes the fuel and water and provides a good dispersion of fuel, water and air. Combustion takes place downstream of this location.

Gaseous fuel and steam may be added via the fourth annular passage to the atomized liquid fuel and air, or alternatively under other operative conditions, may be the only fuel supplied outwardly of the inner swirling air stream. Under these conditions, it is possible to flow only water through the second annular passage and have that dispersed by the co-rotating air streams prior to mixing with the gaseous fuel.

As can be seen, the design of the nozzle is compact and provides for operation of the fuel injector with liquid fuel or gaseous fuel or combinations of both and with liquid water or gaseous water (steam) being added to the mixture to reduce nitrogen oxide emissions.

A particular advantage of constructions which use the center body is a sudden expansion which takes place within the inner chamber that promotes recirculation of the hot combustion gases from downstream. Exemplary recirculation streams are shown for the liquid fuel combustion region 132 and for the steam and gaseous fuel combustion regions 134. The hot gas recirculation zones 132,134 provide for good mixing of the incoming fuel with hot gases. This causes increased stability of combustion under operative conditions of the engine at which the fuel air ratio is lean.

The temperature of the gases in the hot recirculation zones can approach three thousand (3000 ) degrees Fahrenheit. These partially combusted gases and combustion products are blocked from contacting the center body by swirling air discharged from the inner air passage. The sheltering of the center body is enhanced by disposing the center body entirely within the inner air chamber 68. This enhances the durability of the center body in comparison with constructions which permit the center body to extend beyond the inner air chamber and thus cause more exposure of the center body to the hot combustion products. Moreover, the design of the center body is such that the downstream end surface of the center body does not provide a path for the gases to enter the center body and heat the center body from the inside and the outside as do constructions in which the center body extends into the recirculation zone and is of a concave shape. Accordingly, good stability for combustion results from the recirculation zones and structural integrity of the fuel injector is provided by sheltering the center body.

Another advantage results from disposing the liquid fuel passage 57 between the swirling air passages 82 and 104 and disposing the gaseous fuel and steam passage outwardly of the outer air passage 104. Because the conduit 44 for the gaseous fuel and steam is of a much larger diameter than the liquid fuel and water conduit 46, the present construction avoids having the gaseous fuel and steam conduit extend across the outer air passage. The diameter of the liquid fuel conduit is small in comparison to the gaseous fuel conduit and provides a smaller disruption of air flow in the outer air passage in comparison to the disruption which would occur if the gaseous fuel and steam passage were the innermost fuel passage.

The fuel injector is easily assembled by integrally joining the manifold section 62 to the conical deflector section 64 to form a first casing module. The casing module is slidable with respect to the inner wall and the first outer wall. Assembly is further enhanced by the modularity of the inner air supply means 54 which includes the inner wall 66 and its heat shield 70, and the center body 76 and swirl vanes 86 which may be fabricated as a unit.

During assembly the inner air supply means may be fabricated as a one-piece construction and the casing and conical deflector assembled as another one piece construction. The first outer wall 56 is slidable over the inner air supply means and the casing is slidable over the first outer wall to provide the assembled configuration. Thereafter, the first and second conduits are inserted through the casing to complete the construction. All pieces may be brazed together by disposing braze in braze regions $R_a$ and $R_b$ and other locations as required.

Although the invention has been shown and described with respect to detail embodiments thereof, it should be understood by those skilled in the art that various changes in form and detail thereof may be made without departing from the spirit and scope of the claimed invention.

We claim:

1. A fuel injector for a gas turbine engine having passages for liquid fuel and for gaseous fuel extending circumferentially about an axis, the injector having a discharge region downstream of the injector, which comprises:

means for forming two, annular, co-rotating streams of air and for discharging the streams into a discharge region and directing the streams of air toward each other;

means for flowing liquid fuel and water through the injector between the two co-rotating streams prior to discharge from the injector into the discharge region and for discharging the liquid fuel and water into the discharge region between the two co-rotating streams in the discharge region;

means for flowing gaseous fuel and steam through the injector circumferentially about the outermost stream of air and injecting the gaseous fuel and steam into the discharge region;

wherein the disposition of the air passages relative to the gaseous fuel and steam passages avoids having a supply conduit for the gaseous fuel and steam interrupt the outermost air passage and wherein each of the means for flowing fuel is adapted to carry water in the same state as the fuel to efficiently mix water and fuel with rotating air streams.

2. The fuel injector of claim 1 wherein the means for forming two, annular, co-rotating streams of air includes an inner wall extending circumferentially about the axis leaving an inner air chamber inwardly of the wall, the inner air chamber having an upstream end which is open to receiving air from an upstream location and a downstream end for discharging air into the discharge region; an axially extending center body which is entirely disposed in the inner chamber, and which is spaced radially from the inner wall leaving a first annular passage for air therebetween, the center body extending axially toward and into close proximity with the downstream end of the inner wall and being spaced axially from the downstream end of the wall leaving a gap $C_a$ therebetween to provide a region of sudden expansion downstream of the center body within the inner chamber; and, means for imparting a tangential velocity to the air passing through the first passage, which is disposed within the first passage at an axial location which between the upstream end and the downstream end of the inner wall and which extends between the inner wall and the center body.

3. A fuel injector for a gas turbine engine, having passages for liquid fuel and for gaseous fuel extending circumferentially about an axis, the injector having a discharge region downstream of the injector, which comprises:

an inner air supply means which includes an inner wall extending circumferentially about the axis leaving an inner air chamber inwardly of the wall, the inner air chamber having a length $L_w$, an upstream end which is open to receiving air from an upstream location and a downstream end for discharging air into the discharge region, an axially extending center body which is entirely disposed in the inner chamber, the center body having an outer surface which extends axially and which is spaced radially from the inner wall leaving a first annular passage for air therebetween, the center body extending for a length $L_{cb}$ which is greater than half the length of the inner wall $L_w$ ($L_{cb} > L_w/2$), the center body extending axially toward and into close proximity with the downstream end of the inner wall and having a downstream end surface which extends radially to join the outer surface and block gases from entering the center body, the downstream end surface being spaced axially from the downstream end of the wall leaving a gap $C_a$ therebetween to provide a region of sudden expansion downstream of the center body within the inner chamber;

means for imparting a tangential velocity to the air passing through the first passage, which is disposed within the first passage at an axial location which is about midway between the upstream end and the downstream end of the inner wall and which extends between the inner wall and the center body;

a first outer wall spaced radially from the inner wall leaving a second annular passage for liquid fuel therebetween, the liquid fuel passage having a downstream end for discharging liquid fuel into the discharge region;

a casing having a second outer wall spaced radially from the first outer wall leaving a third annular passage for air therebetween, the third passage having an upstream end which is open to receiving air from an upstream location and a downstream end for discharging air into the discharge region;

means for imparting a tangential velocity to the air passing through the third annular passage, which is disposed within the third passage at an axial location which is adjacent to the axial location of the downstream end of the inner wall;

a third outer wall which is spaced radially from the second outer wall leaving a fourth annular passage for gaseous fuel therebetween, the fourth passage having a downstream end for discharging gaseous fuel into the discharge region;

a first conduit means which is in flow communication with the fourth annular passage and which is adapted to be in flow communication with a source of gaseous fuel and a source of steam;

a second conduit means extending across the third annular passage for air to the second annular passage for fuel which is in flow communication with the second annular passage and which is adapted to be in flow communication with a source of liquid fuel and a source of water;

wherein air passing over the center body which is disposed entirely within the inner chamber blocks the hot gases recirculating in the discharge region of the nozzle from overheating the center body and wherein the sudden expansion at the downstream end of the center body promotes recirculation of the gases to increase stability of combustion under different operative conditions of the nozzle.

4. The fuel injector of claim 3 wherein the inner wall includes a heat shield which is radially inwardly of the second annular passage and wherein the first outer wall is hollow over an axial portion of the first outer wall adjacent to the second annular passage such that the heat shield and first outer wall block the transfer of heat from the air in the first annular passage and the third annular passage to the liquid fuel in the second annular passage.

* * * * *